US010815691B2

(12) United States Patent
Bicic

(10) Patent No.: US 10,815,691 B2
(45) Date of Patent: Oct. 27, 2020

(54) FIXATION OF DOOR LOCKS WITHOUT SCREWS INTO HOME APPLIANCES

(71) Applicant: ILLINOIS TOOL WORKS INC., Glenview, IL (US)

(72) Inventor: Bojan Bicic, Pecine (SI)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1109 days.

(21) Appl. No.: 14/412,256

(22) PCT Filed: Jul. 5, 2013

(86) PCT No.: PCT/US2013/049486

§ 371 (c)(1),
(2) Date: Dec. 31, 2014

(87) PCT Pub. No.: WO2014/011509

PCT Pub. Date: Jan. 16, 2014

(65) Prior Publication Data

US 2015/0191932 A1 Jul. 9, 2015

(30) Foreign Application Priority Data

Jul. 9, 2012 (IT) ..... T02012A0606

(51) Int. Cl.
*E05B 9/08* (2006.01)
*D06F 39/14* (2006.01)

(52) U.S. Cl.
CPC ..... *E05B 9/08* (2013.01); *D06F 39/14* (2013.01); *Y10T 70/8541* (2015.04)

(58) Field of Classification Search
CPC ..... E05B 9/08; E05B 15/1635; D06F 39/14; Y10T 70/8541; Y10T 292/0911;
(Continued)

(56) References Cited

U.S. PATENT DOCUMENTS 3,841,674 A * 10/1974 Bisbing ..... E05B 5/00 292/175
5,183,302 A * 2/1993 Pelachyk ..... E05B 85/12 292/336.3

(Continued)

FOREIGN PATENT DOCUMENTS

CN 101180427 A 5/2008
CN 101285258 A 10/2008

(Continued)

OTHER PUBLICATIONS

ISR and WO for PCT/US2013/049486 dated Oct. 14, 2013.

*Primary Examiner* — Christine M Mills
(74) *Attorney, Agent, or Firm* — Pilloff Passino & Cosenza LLP; Martin J. Cosenza

(57) ABSTRACT

A door-locking device for a domestic appliance, including a fastening portion for fastening without screws the door-locking device to a front panel of the domestic appliance, the fastening portion including a body having an opening intended to receive a hook connected to the door of the domestic appliance, the body including an integral engagement portion projecting from a bottom wall of the body and including first and second opposite teeth adapted to engage opposite edges of an aperture of the front panel.

20 Claims, 9 Drawing Sheets

(58) Field of Classification Search
CPC ..... Y10T 292/03; Y10T 292/0894; A47L 15/4259; Y10S 292/38; Y10S 292/53; Y10S 292/64
USPC ... 292/95, 1, 80, DIG. 38, DIG. 53, DIG. 64
See application file for complete search history.

(56) References Cited

U.S. PATENT DOCUMENTS

| | | | | | |
|---|---|---|---|---|---|
| 5,263,750 | A * | 11/1993 | Smith | E05B 85/12 | 292/336.3 |
| 5,715,563 | A * | 2/1998 | Marks | B60S 1/4003 | 15/250.32 |
| 6,052,948 | A * | 4/2000 | Spitzley | E05B 79/06 | 49/460 |
| 6,230,443 | B1 * | 5/2001 | Schultz | E05D 15/22 | 49/181 |
| 6,345,946 | B1 | 2/2002 | Mainini et al. | | |
| 8,448,482 | B2 * | 5/2013 | Schuck | D06F 39/14 | 68/196 |
| 2006/0110235 | A1 * | 5/2006 | Dembowsky | B60N 2/5825 | 411/349 |
| 2008/0238113 | A1 | 10/2008 | Ricchitelli | | |
| 2009/0039657 | A1 | 2/2009 | Schuck | | |
| 2014/0001934 | A1 | 1/2014 | Batur et al. | | |

FOREIGN PATENT DOCUMENTS

| | | | |
|---|---|---|---|
| EP | 1418266 | A2 | 5/2004 |
| EP | 1936018 | A1 | 6/2008 |
| WO | 2010092529 | A1 | 8/2010 |
| WO | 2010101533 | A1 | 9/2010 |
| WO | 2012084483 | A1 | 6/2012 |

* cited by examiner

FIXATION OF DOOR LOCKS WITHOUT SCREWS INTO HOME APPLIANCES

RELATED APPLICATIONS

The present application is a National Phase of International Application Number PCT/US2013/049486 filed Jul. 5, 2013, and claims priority to Italian Application Number TO2012A000606 filed Jul. 9, 2012.

FIELD OF THE INVENTION

The present invention relates to a door-locking device for locking in a closed position the door of a domestic appliance, such as a washing machine or the like.

In particular, the present invention relates to a door-locking device which can be fixed on a front panel of a domestic appliance without screws.

RELATED ART

WO-A-2010/101533 discloses a fastening device which can be used for fixing without screws a door-locking device to the front panel of a domestic appliance. The fastening device has a body with an engagement portion projecting from a bottom wall and including first and second opposite teeth adapted to engage opposite edges of an aperture of the front panel. The fastening device includes a protection plate including a pair of integral pins which are adapted to engage respective holes formed in the front panel. The protection plate is movable with respect to the body of the fastening device between an unlocking position and a locking position. In the locking position the pins snap engage the body of the fastening device, so as to fix the protection plate to the body. In the fastened position the pins have respective ends which project from the bottom wall of the body.

One of the drawbacks of the solution according to WO-A-2010/101533 is that for mounting the door-locking device on the domestic appliance the operator must first engage the door-locking device with the aperture of the front panel of the domestic appliance and then push the protection plate in the locking position. This solution cannot be used in all models of domestic appliances. A further drawback is that the protection plate could snap to the locking position during transport and delivery; in such case it would not be possible to mount the door-locking device on the domestic appliance.

WO-A-2010/0092529 discloses a door-locking device comprising a rigid body having a protruding structure in which there is provided an opening intended to receive a hook connected to the door of the domestic appliance. The body has two seats provided on opposite sides of the protruding structure and intended to engage corresponding edges of an opening provided in a front panel of the domestic appliance. A member of resilient material is overmoulded inside a first seat. The body has a pair of rigid projection capable of engaging corresponding through holes of the front panel.

This solution has the disadvantage of requiring a member of resilient material overmoulded in the seat of the engagement portion, in order to allow a resilient movement needed for the engagement of the rigid projections with the corresponding holes of the front panel.

OBJECT AND SUMMARY OF THE INVENTION

The object of the present invention is to provide a door-locking device which overcomes the drawbacks of the prior art solutions and having a simple and inexpensive structure.

In accordance with the present invention, this object is achieved by a door-locking device having the features of claim 1.

The claims form an integral part of the teachings administered in relation to the invention.

BRIEF DESCRIPTION OF THE DRAWINGS

The present invention will now be described in detail with reference to the annexed drawings, given purely by way of non-limiting example, in which.

DESCRIPTION OF EMBODIMENTS OF THE INVENTION

Figure 1:
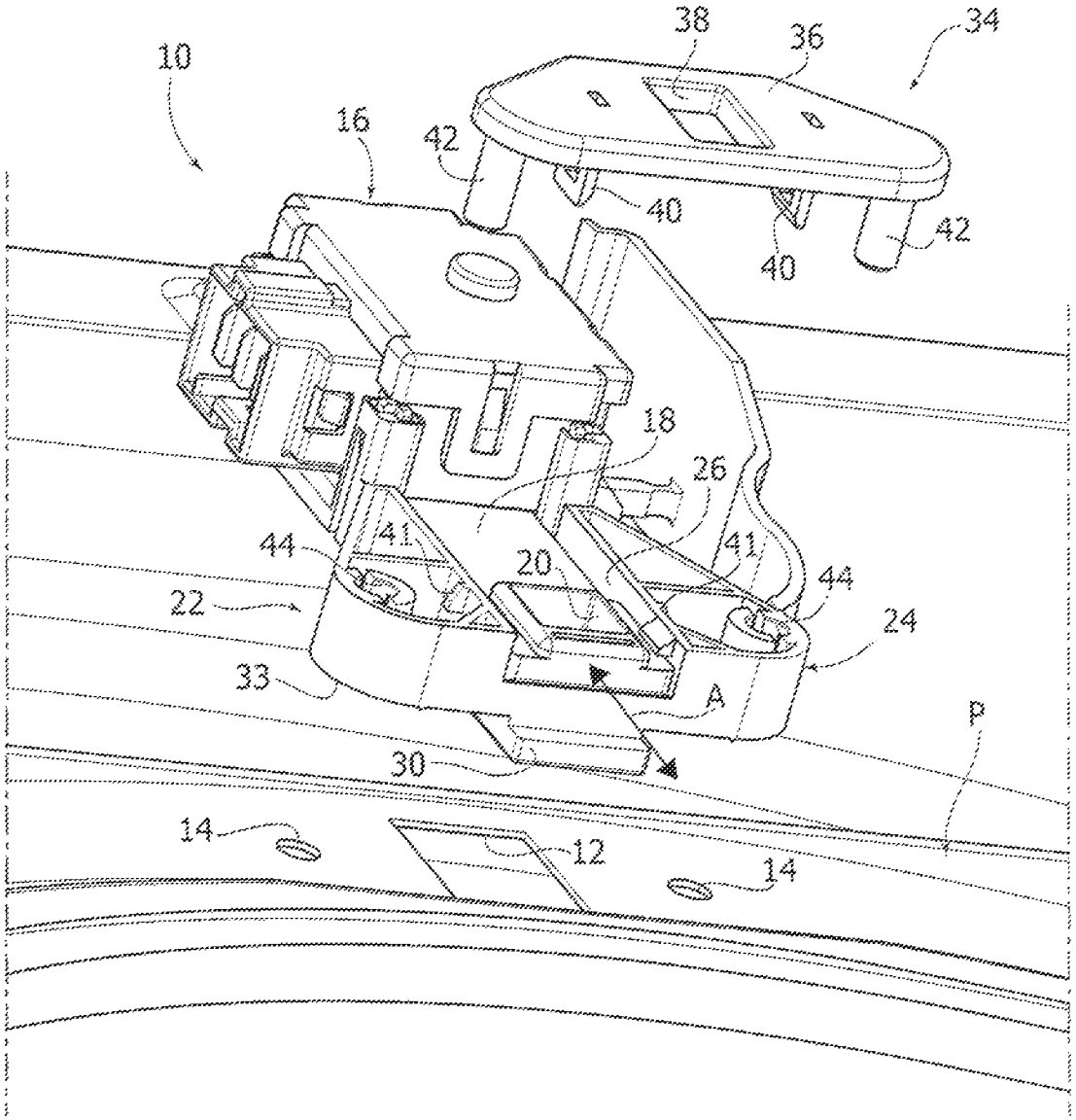
FIG. 1 is partially exploded prospective view of a door-locking device according to a first embodiment of the present invention.
Figure 2:
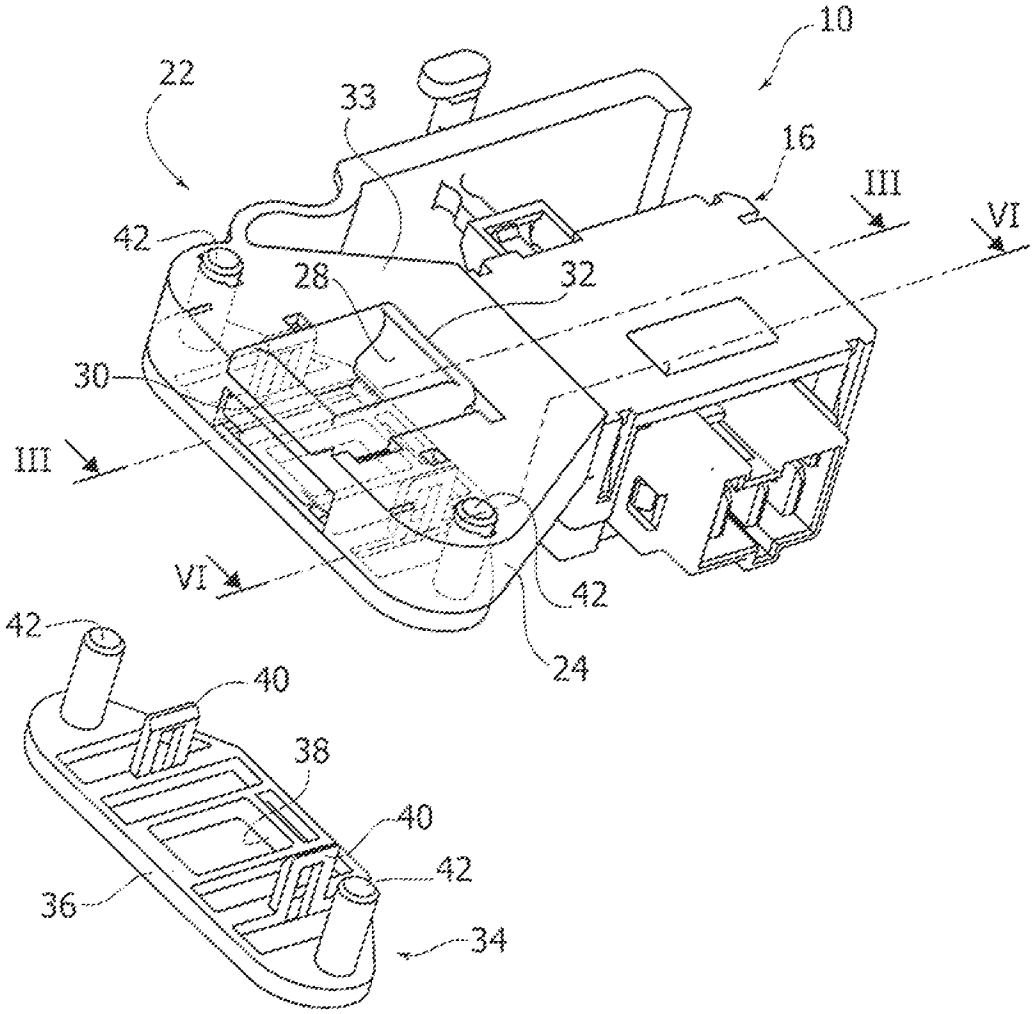
FIG. 2 is a perspective view of the door-locking device of FIG. 1 from a different angle.

With reference to FIGS. 1 and 2, a door-locking device according to the present invention is indicated by the reference number 10. The door-locking device 10 is intended to be mounted on a front panel P of a domestic appliance. The front panel P has a quadrangular opening 12 and a pair of circular holes 14 set on opposite sides of quadrangular opening 12.

The door-locking device 10 comprises a housing 16 and a locking slider 18 which is movable with respect to the housing 18 along a longitudinal direction indicated by the double arrow A. The slider 18 has an aperture 20 which is intended to receive a hook connected to the door (not shown) of the domestic appliance. The housing 16 contains an electrically actuated locking mechanism adapted to lock the slider 18 in a locking position, in which the slider 18 locks the door in the closed position.

The door-locking device 10 comprises a fastening portion 22 adapted to fix the door-locking device 10 to the front panel P without screws. The fastening portion 22 comprises a body 24 of injection-moulded plastic material. The body 24 is fixed to or integral with the housing 16 of the door-locking device 10. The body 24 has a channel 26 in which is movably guided the slider 18. The body 24 has an aperture 28 (FIG. 2) aligned with the aperture 20 of the slider 18 and adapted to receive the hook of the door.

The body 24 has an integral engagement portion including first and second teeth 30, 32 projecting from a bottom wall 33 of the body 24 on opposite sides of the aperture 28. The teeth 30, 32 are configured for engaging opposite edges of the aperture 12 of the front panel P, as will be disclosed in the following.

The fastening portion 22 comprises a protection plate 34 fixed to the side of the body 24 opposite to the bottom wall 33, so as to close the upper part of the body 24. The protection plate 34 is a separate component with respect to the body 24. The protection plate 34 comprises a base wall 36 having an aperture 38 aligned with the apertures 20, 28 of the slider 18 and body 24. The base wall 36 has a pair of integral tabs 40 projecting therefrom and configured for snap-engaging respective teeth 41 integral with the body 24. The protection plate 34 also includes a pair of integral projecting pins 42 which project from lateral portions of the base wall 36 orthogonally thereto. The pins 42 are inserted with play into respective elongated holes 44 of the body 24. The pins 42 are free to move axially into the holes 44 when the protection plate 34 is fixed to the body 24 by means of the tabs 40. The axial movement of the pins 42 into the respective elongated holes 44 is allowed by an elastic deformation of the lateral portions of the base wall 36. When the protection plate 34 is fixed to the body 24, the front ends of the pins 42 project from the bottom wall 33 of the body 24. The front ends of the pins 42 are intended to engage into the holes 14 of the front panel P, as will be disclosed in the following.

The sequence of the steps for fastening the door-locking device 10 to the front panel P are described in the following with reference to FIGS. 3 to 10.

Figure 3:
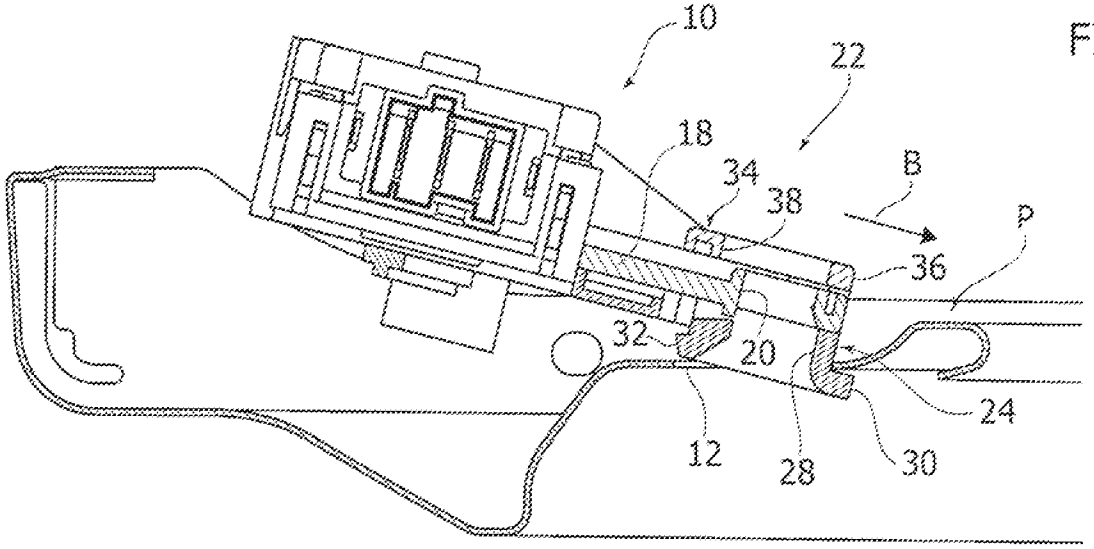
FIGS. 3, 4 and 5 are cross-sections taken along the line III-III of FIG. 2 and showing the sequence for mounting the door-locking device on a front panel of a domestic appliance.
Figure 6:
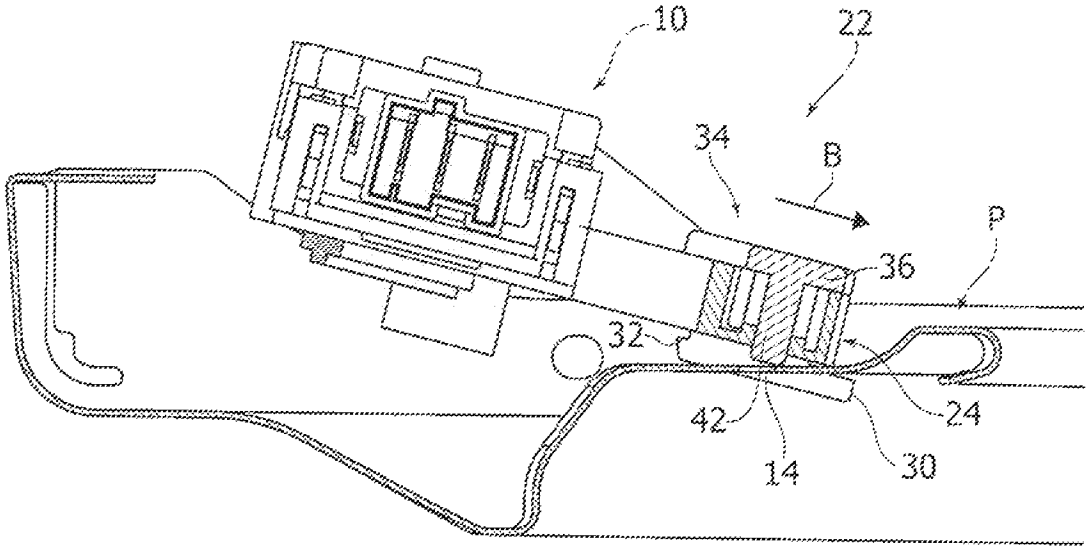
FIGS. 6, 7 and 8 are cross-sections taken along the line VI-VI of FIG. 2 and corresponding to FIGS. 3, 4 and 5, FIGS. 9 and 10 are cross-sections taken along the lines IX-IX of FIG. 7 and X-X of FIG. 8.

In a first step, as shown in FIGS. 3 and 6, the door-locking device 10 is moved towards the panel P in the direction indicated by the arrow B so as to engage the first tooth 30 with a first edge the quadrangular opening 12 of the front panel P. In this condition, the first tooth 30 is positioned on the front side of the panel P, whereas the second tooth 32 is on the rear side of the panel P.

Figure 4:
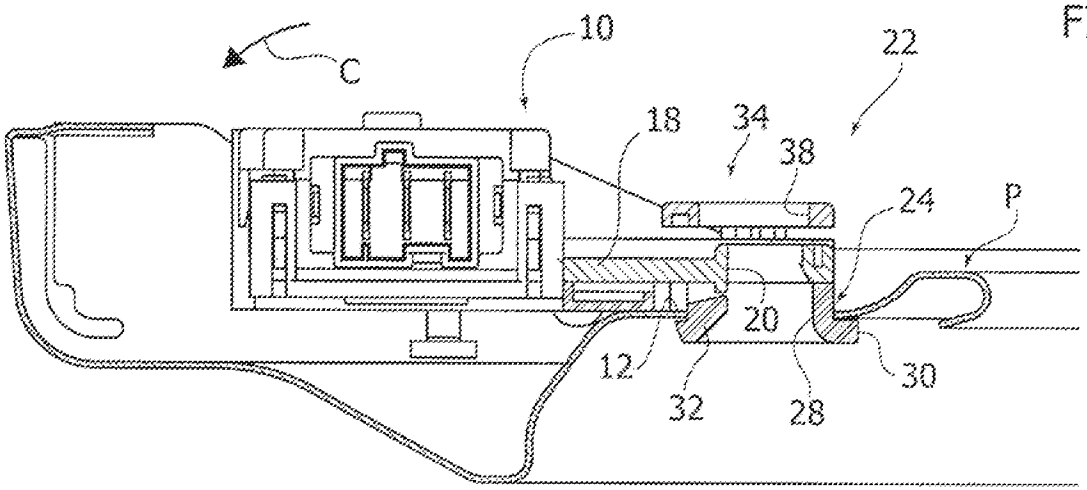
Figure 7:
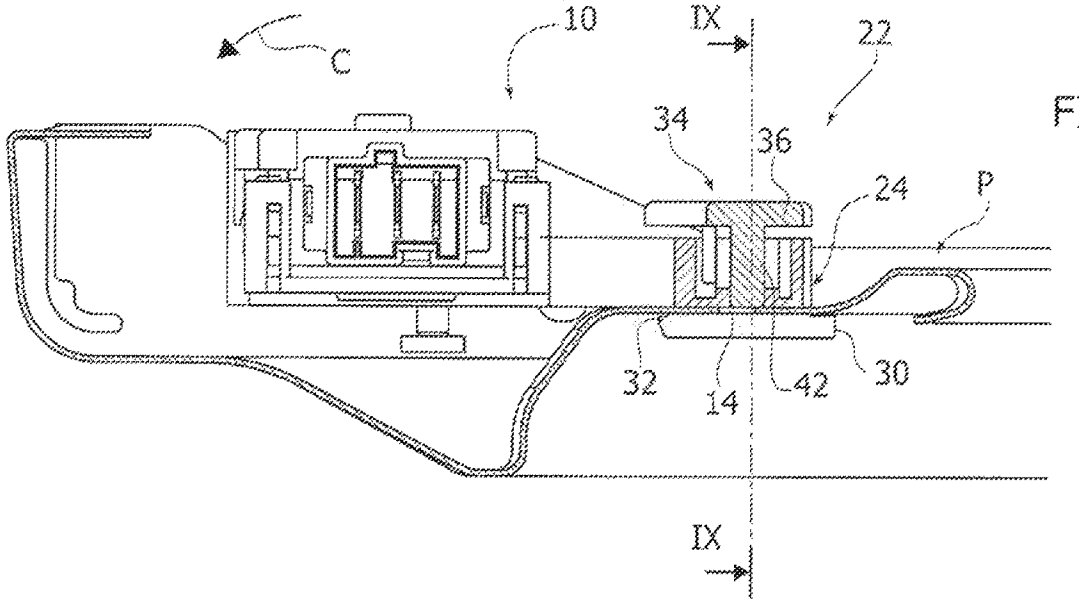
Figure 9:
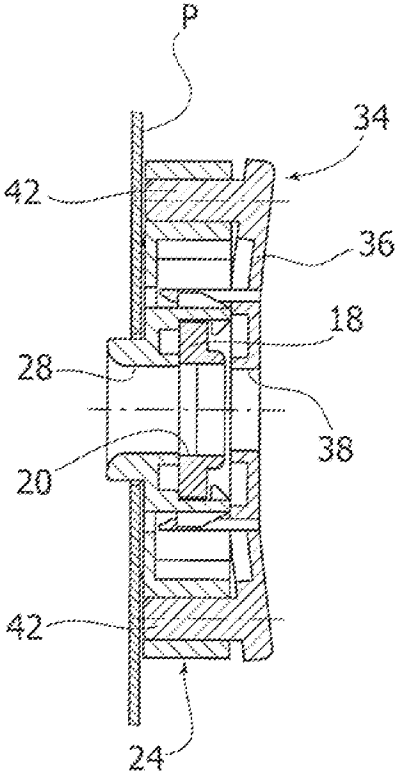

In a second step, as shown in FIGS. 4 and 7, the door-locking device 10 is rotated towards the panel P in the direction indicated by the arrow C, so that the second tooth 32 passes through the opening 12 and is positioned on the front side of the panel P. In this condition the ends of the pins 42 are not engaged with the holes 14. The front ends of the pins 42 abut on the inner surface of the panel P. Therefore, the pins 42 are in retracted position with respect to the body 24. In this condition, the lateral portions of the base wall 36 of the protection plate 34 are elastically deformed as shown in FIG. 9.

Figure 5:
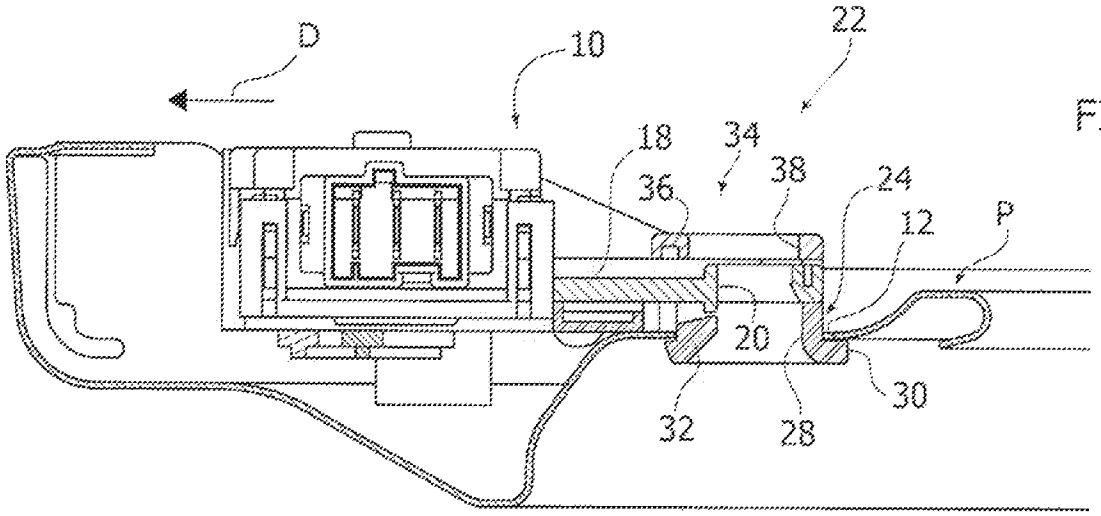
Figure 8:
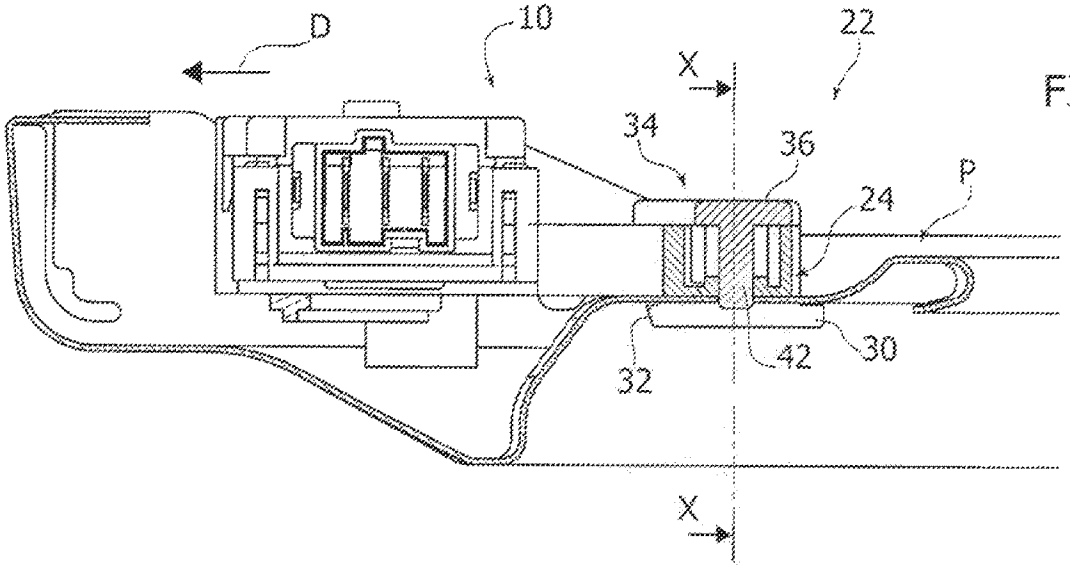

In the final step, as shown in FIGS. 5 and 8, the door-locking device 10 is moved in the direction indicated by the arrow D. This movement brings the second tooth 32 in engagement with the second edge of the opening 12 and, at the same time, brings the front ends of the pins 42 in correspondence with the holes 14 of the front panel P. When the front ends of the pins 42 meet the holes 14, the pins 42 snap into engagement with the holes 14 under the elastic force which returns the base wall 36 in the undeformed position.

Figure 10:
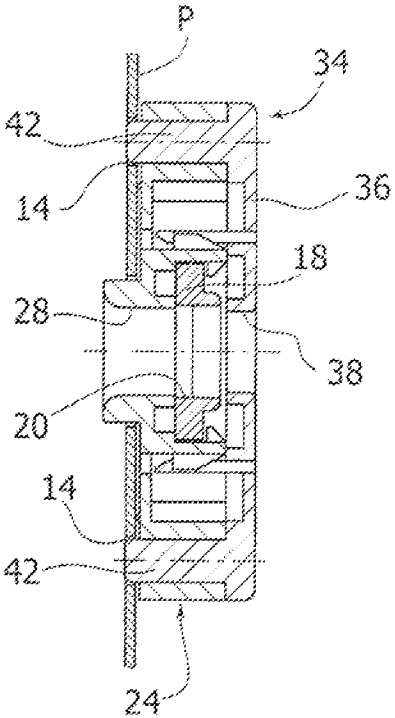

As shown in FIG. 10, in the final position the pins 42 are in an extracted position with respect to the body 24 of the fastening portion 22. The front ends of the pins 42 which project beyond the bottom wall 33 of the body 24 engage the holes 14 of the front panel P. In this condition both the first and the second tooth 30, 32 are engaged with respective edges of the opening 12. In this condition the door-locking device 10 is fixed to the front panel P.

Figure 12:
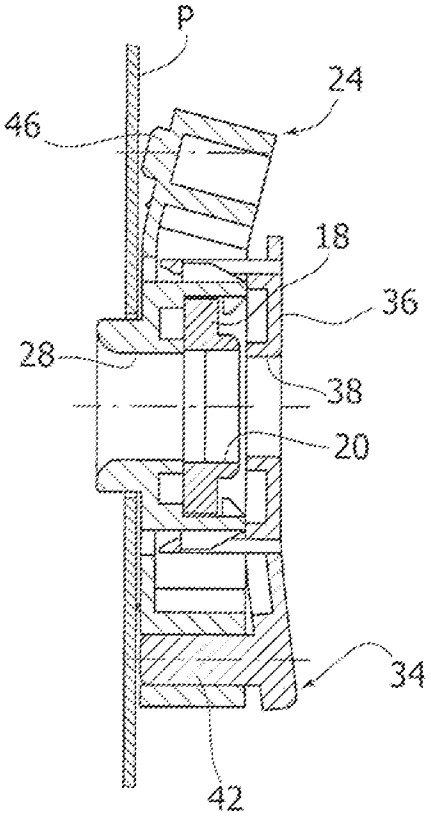
FIGS. 12 and 13 are cross-sections of the door-locking device of FIG. 11 corresponding to the FIGS. 9 and 10.
Figure 11:
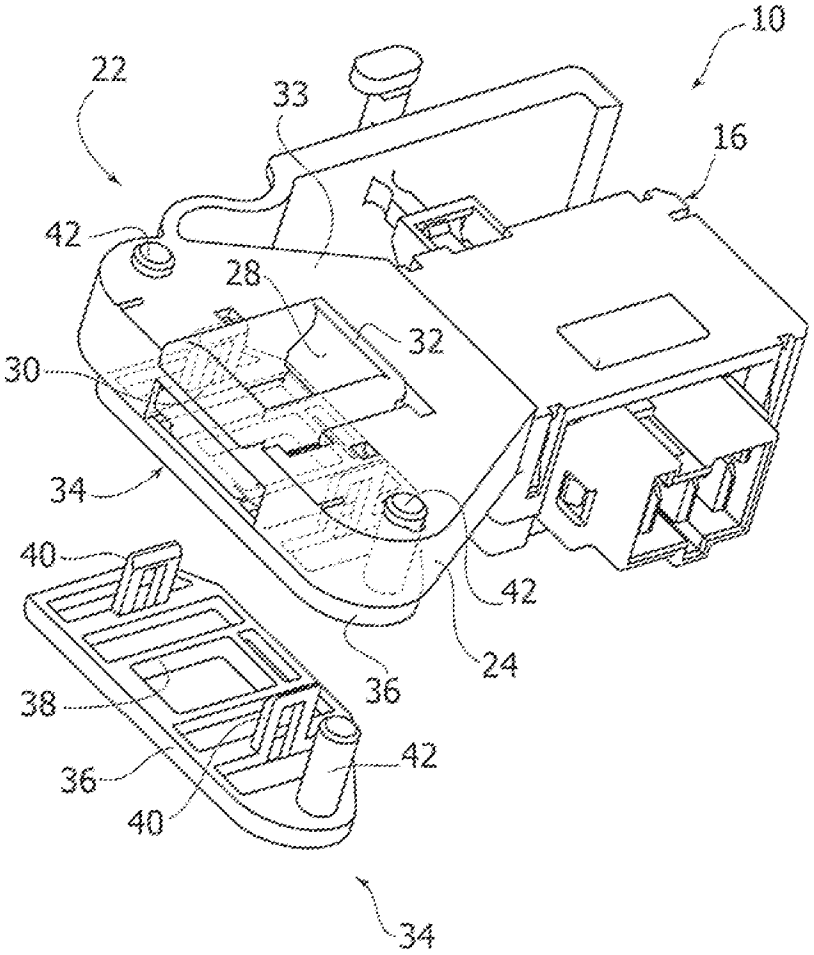
FIG. 11 is a perspective view showing a second embodiment of a door-locking device according to the present invention.
Figure 13:
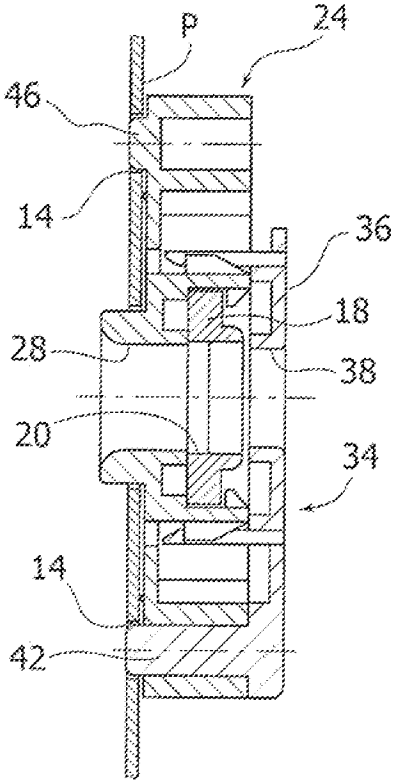

In the embodiment shown in FIGS. 1 to 10 the protection plate 34 has two pins 42. However, the fastening of the door-locking device 10 would be equally effective even with only one pin 42. FIGS. 11-13 show a second embodiment of the present invention wherein the protection plate 34 is provided with only one pin 42. In this second embodiment, the body 24 of the fastening portion 22 has a rigid projection 46 projecting from the bottom wall 33, opposite to the front end of the pin 42 with respect to the opening 28.

The mounting sequence of the door-locking device of FIG. 11 is identical to what previously described. FIG. 12 shows a condition corresponding to FIG. 9. The pin 42 is in the retracted position and the corresponding lateral portion of the base wall 36 of the protection plate 34 is deformed. The rigid projection 46 abuts against the inner surface of the front panel P and the corresponding lateral portion of the body 24 is elastically deformed. When the door-locking device 10 is moved in the final fastening position, the front end of pin 42 and the rigid projection 46 engage the respective holes 14, as shown in FIG. 13. The pin 42 is moved to the extracted position by the elastic return force of base wall 36 of the protection plate 34 whereas the rigid projection 46 is moved into engagement with the hole 14 by the elastic return force of the body 24.

Figure 14:
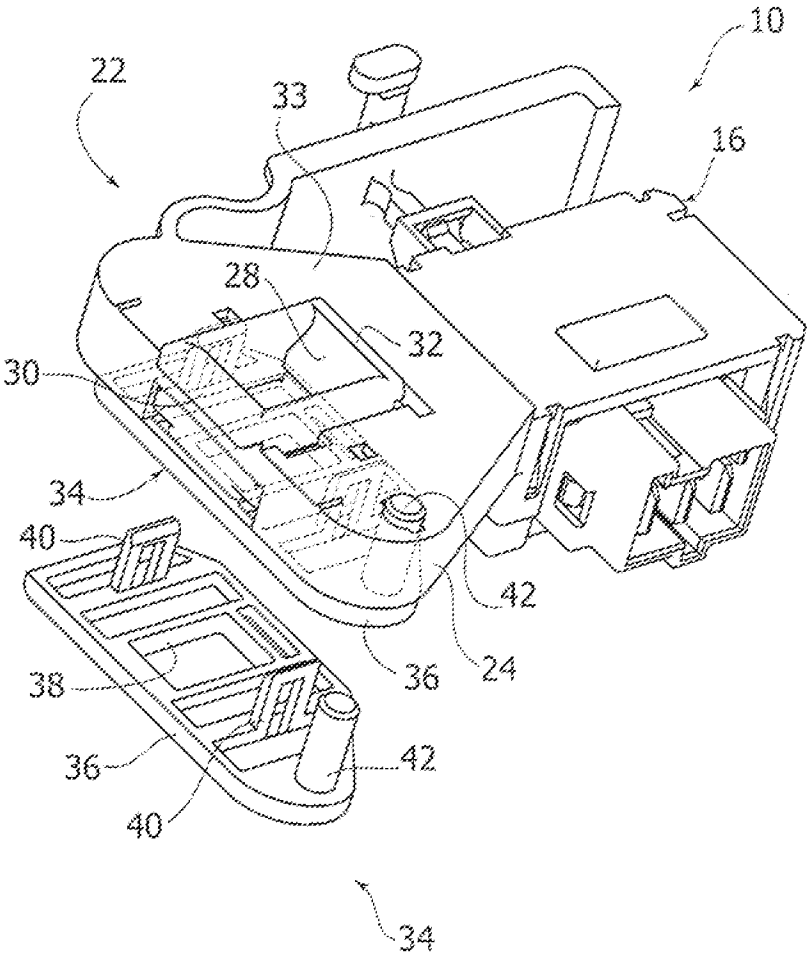
FIG. 14 is a perspective view of a third embodiment of a door-locking device according to the present invention.
Figure 16:
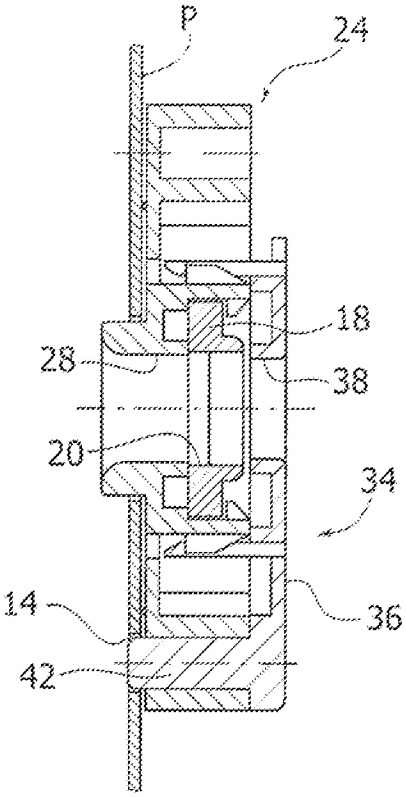
FIGS. 15 and 16 are cross-sections of the door-locking device of FIG. 14 corresponding to FIGS. 9 and 10.
Figure 15:
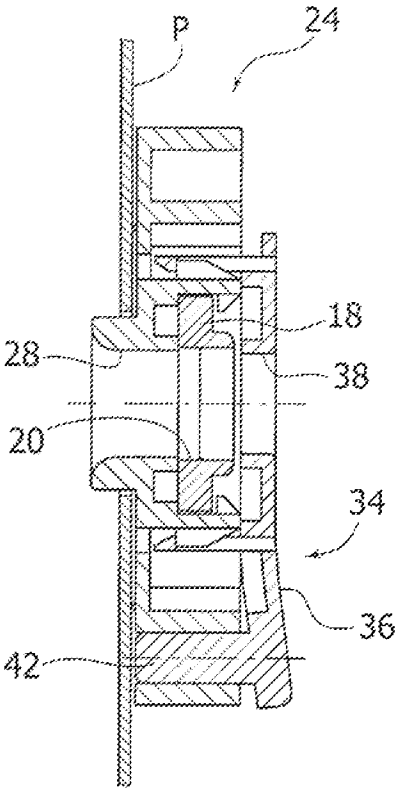

FIGS. 14 to 16 show a third embodiment of the present invention. The protection plate 34 has a single pin 42 as in the second embodiment. In this case, there is no rigid projection on the bottom wall 33 of the body 24. As shown in FIG. 15, in this case there is no deformation of the lateral portion of the body 24 during the fastening operation of the door-locking device. FIG. 16 shows the final fixing position with only one pin 42 engaging the respective hole 14.

The invention claimed is:

1. A door-locking device for a domestic appliance, comprising a fastening portion for fastening without screws the door-locking device to a front panel of the domestic appliance, the fastening portion comprising:

a body having an opening intended to receive a hook connected to the door of the domestic appliance, the body including an integral engagement portion projecting from a bottom wall of the body and including first and second opposite teeth adapted to engage opposite edges of an aperture of the front panel, and a protection plate attached to a side of said body opposite to said bottom wall, the protection plate including a base wall and at least one integral pin projecting away from a surface of a lateral portion of said base wall and having a front end projecting from said bottom wall of the body and adapted to engage a hole of said front panel, wherein said protection plate is attached to said body wherein said at least one integral pin is free to move axially with respect to said body between a retracted position and an extracted position, said movement of the at least one integral pin being allowed by an elastic deformation of the surface of the lateral portion of said base wall, and wherein at least one of:

the elastic deformation angularly moves the at least one integral pin;

the elastic deformation is caused by a force travelling through the at least one integral pin to the base wall, and wherein the deformation is a result of a force transmitted from one side of the protection plate to an opposite side of the protection plate; or the elastic deformation is in a plane that lies on a longitudinal extension of the at least one integral pin.

2. A door-locking device according to claim 1, wherein the protection plate has a pair of tabs projecting from said base wall which engage respective teeth of said body to attach the protection plate to the body, wherein the elastic deformation is separate from any respective elastic deformation of respective tabs of the pair of tabs.

3. A door-locking device according to claim 1, wherein the protection plate and the body is connected to the front panel of the domestic appliance without screws, and wherein an end of the at least one integral pin extends into a hole in the front panel.

4. A door-locking device according to claim 1, wherein with respect to distance from a first lateral end to a second lateral end of the base wall, a location at a mid-distance point between the first lateral end and the second lateral end remains static relative to the body when the elastic deformation of the surface of the lateral portion of said base wall occurs to achieve said movement of the at least one integral pin, wherein the first lateral end and the second lateral end lift up in a direction parallel to a longitudinal axis of the hole of said front panel away from the body above the location at the mid-distance point when the elastic deformation of the surface of the lateral portion of said base wall occurs.

5. A door-locking device according to claim 1, wherein the deformation is caused by the force travelling through the at least one integral pin to the base wall, and wherein the deformation is the result of the force transmitted from one side of the protection plate to the opposite side of the protection plate.

6. A door-locking device according to claim 1, wherein the elastic deformation is in the plane that lies on the longitudinal extension of the at least one integral pin.

7. A door-locking device according to claim 1, wherein the elastic deformation angularly moves the at least one integral pin.

8. A door-locking device for a domestic appliance, comprising a fastening portion for fastening without screws the door-locking device to a front panel of the domestic appliance, the fastening portion comprising:

a body having an opening configured to receive a hook connected to the door of the domestic appliance, the body including an integral engagement portion projecting from a bottom wall of the body and including first and second opposite teeth adapted to engage opposite edges of an aperture of the front panel, and a protection plate attached to a side of said body opposite to said bottom wall, the protection plate including a base wall and at least one integral pin projecting away from a surface of a lateral portion of said base wall and having a front end projecting from said bottom wall of the body and adapted to engage a hole of said front panel, wherein the protection plate is fastened to said body such that said at least one integral pin is free to move axially with respect to said body between a retracted position and an extracted position, said movement of the at least one integral pin being allowed by an elastic deformation of the surface of the lateral portion of said base wall, and wherein at least one of:

the elastic deformation angularly moves the at least one integral pin;

the elastic deformation is caused by a force travelling through the at least one integral pin to the base wall, and wherein the deformation is a result of a force transmitted from one side of the protection plate to an opposite side of the protection plate; or the elastic deformation is in a plane that lies on a longitudinal extension of the at least one integral pin.

9. A door-locking device according to claim 8, wherein the protection plate has a pair of tabs projecting from said base wall which engage respective teeth of said body to attach the protection plate to the body.

10. A door-locking device according to claim 8, wherein the base wall of the protection plate has two integral pins projecting from opposite lateral portions of the base wall.

11. A door-locking device according to claim 8, wherein the at least one integral pin is located in a respective hole in the body with play.

12. A door-locking device according to claim 8, wherein the protection plate includes two tabs that are integral therewith, which snap the protection plate to the body, which are separate from the surface that elastically deforms.

13. A door-locking device according to claim 8, wherein the protection plate and the body is connected to the front panel of the domestic appliance without screws, and wherein the first and second opposite teeth engage opposite edges of the aperture of the front panel, and wherein the body is movable relative to the front panel with the first and second opposite teeth engaged with the opposite edges of the aperture.

14. A door-locking device according to claim 8, wherein an amount of the elastic deformation that occurs in a portion of the surface that deforms has a linear relationship with an amount of movement of the at least one integral pin.

15. A door-locking device according to claim 8, wherein the door-locking device is configured such that the deformation is caused by a force travelling through the at least one integral pin to the base wall, and wherein the deformation is a result of a force transmitted from one side of the body to an opposite side of the body.

16. A door-locking device according to claim 8, wherein the protection plate and the body is connected to the front panel of the domestic appliance without screws, and wherein the first and second opposite teeth engage opposite edges of the aperture of the front panel, and wherein the protection plate is movable relative to the front panel with the first and second opposite teeth engaged with the opposite edges of the aperture.

17. A door-locking device according to claim 8, wherein the deformation is caused by the force travelling through the at least one integral pin to the base wall, and wherein the deformation is the result of the force transmitted from one side of the protection plate to the opposite side of the protection plate.

18. A door-locking device according to claim 8, wherein the elastic deformation is in the plane that lies on the longitudinal extension of the at least one integral pin.

19. A door-locking device according to claim 8, wherein the elastic deformation angularly moves the at least one integral pin.

20. A door-locking device according to claim 8, wherein the at least one pin includes two pins, and the deformation causes the base wall to symmetrically flap about a plane equidistant between the two pins.

* * * * *